US012480394B2

(12) United States Patent
Soerheim et al.

(10) Patent No.: US 12,480,394 B2
(45) Date of Patent: Nov. 25, 2025

(54) METHOD AND APPARATUS FOR ACID STIMULATION

(71) Applicant: CONOCOPHILLIPS COMPANY, Houston, TX (US)

(72) Inventors: Jan Ove Soerheim, Tananger (NO); Maxim Prosvirnov, Tananger (NO); Elizabeth R. Mathis, Houston, TX (US); Tollef Svenum, Tananger (NO)

(73) Assignee: CONOCOPHILLPS COMPANY, Houston, TX (US)

( * ) Notice: Subject to any disclaimer, the term of this patent is extended or adjusted under 35 U.S.C. 154(b) by 0 days.

(21) Appl. No.: 18/053,841

(22) Filed: Nov. 9, 2022

(65) Prior Publication Data

US 2023/0144711 A1 May 11, 2023

Related U.S. Application Data

(60) Provisional application No. 63/277,461, filed on Nov. 9, 2021.

(51) Int. Cl.
*E21B 43/27* (2006.01)
*E21B 43/25* (2006.01)

(52) U.S. Cl.
CPC ..... *E21B 43/27* (2020.05); *E21B 43/25* (2013.01)

(58) Field of Classification Search
CPC ..... E21B 43/27; E21B 43/25; E21B 41/003; E21B 23/00; E21B 23/0413
See application file for complete search history.

(56) References Cited

U.S. PATENT DOCUMENTS

| | | | | |
|---|---|---|---|---|
| 3,612,179 | A * | 10/1971 | Anderson | C09K 8/94 166/281 |
| 7,428,933 | B2 * | 9/2008 | Miller | E21B 43/10 166/242.9 |
| 8,220,547 | B2 * | 7/2012 | Craig | E21B 41/0035 166/308.1 |
| 2003/0221843 | A1 | 12/2003 | Fipke et al. | |
| 2005/0115713 | A1 | 6/2005 | Restarick et al. | |
| 2010/0314109 | A1 * | 12/2010 | Garcia | E21B 43/04 166/278 |
| 2016/0040520 | A1 | 2/2016 | Tolman et al. | |

(Continued)

FOREIGN PATENT DOCUMENTS

| | | |
|---|---|---|
| WO | 2014022589 | 2/2014 |
| WO | 2019221818 A1 | 11/2019 |

OTHER PUBLICATIONS

International Search Report, PCT/US2022/079569 mailed Mar. 16, 2023; 4 pgs.

*Primary Examiner* — Nicole Coy
*Assistant Examiner* — Jennifer A Railey
(74) *Attorney, Agent, or Firm* — CONOCOPHILLIPS COMPANY

(57) ABSTRACT

The invention relates to a method and apparatus for performing acid stimulation of a hydrocarbon well (1), especially in a multi-lateral branched well system. In the first lateral (8), after installation of the production liner (9) with ball-activated completion equipment (10), acid stimulation is performed through drill string (21) which is introduced into the well and which seals with the production liner (9) by means of a stinger (22) and polished bore receptacle (23) before introduction of acid.

9 Claims, 4 Drawing Sheets

(56) References Cited

U.S. PATENT DOCUMENTS

| | | | | |
|---|---|---|---|---|
| 2016/0319625 | A1* | 11/2016 | Conrad | E21B 34/14 |
| 2018/0274300 | A1* | 9/2018 | Vemuri | E21B 43/14 |
| 2019/0242224 | A1* | 8/2019 | Keller | E21B 43/26 |
| 2019/0277122 | A1* | 9/2019 | Mahmoud | C09K 8/74 |
| 2021/0332658 | A1 | 10/2021 | Hepburn et al. | |

* cited by examiner

METHOD AND APPARATUS FOR ACID STIMULATION

CROSS-REFERENCE TO RELATED APPLICATIONS

This application is a non-provisional application which claims benefit under 35 USC § 119(e) to U.S. Provisional Application Ser. No. 63/277,461 filed Nov. 9, 2021 entitled " METHOD AND APPARATUS FOR ACID STIMULATION," which is incorporated herein in its entirety.

STATEMENT REGARDING FEDERALLY SPONSORED RESEARCH

None.

FIELD OF THE INVENTION

This invention relates to a method and apparatus for stimulation of subsea hydrocarbon wells, e.g. acid stimulation of hydrocarbon wells in subsea chalk reservoirs.

BACKGROUND OF THE INVENTION

In the process of completing a hydrocarbon well after drilling a stimulation operation is often conducted. This may include stimulation by pressurized injection of fluid and a proppant, or it may include injection of acid, especially if the formation is of a type which lends itself to being opened up by acid, e.g. if the rock of carbonate composition (chalk or limestone).

The conventional procedure is to drill and case the well, then run in the production liner and production tubing. The liner is then perforated and fluid (e.g. acid) passed successively through sections of the liner to stimulate the rock. Successive stimulation stages are initiated by passing balls or other actuating devices down the production liner to activate sleeve mechanisms to open and close different parts of the liner.

Production tubing is not able to withstand the high pressure normally required for stimulation, so the annulus around the tubing is maintained under pressure to support the tubing; even so, the pressure at which fluid can be delivered is limited. Fluid is often delivered just through the production liner.

More recently, lateral wells with branching have been created to maximize production from a hydrocarbon bearing formation. When creating a branched well, the first lateral is created and then stimulated, and then a second lateral drilled and stimulated. In multilaterals the stimulation in the first lateral may be performed through coil tubing. The second lateral is then stimulated through the production liner.

In drilling and completion operations it is always desirable to reduce the number of trips in and out of the well, each of which takes time. It is also desirable to reduce the number of days of drilling rig time required for the operation since rig time is extremely expensive.

In multilateral drilling a drilling rig is normally required to create the main well and the first lateral, and then must stand idle whilst a coil tubing unit conducts the completion operation through coil tubing, before the rig moves in again and drills the second, branched lateral.

A further problem with stimulation through coil tubing is that the tubing is relatively narrow, limiting the size of ball or actuator which can be dropped. Also, as with production tubing, the pressure at which the fluid can be delivered is limited.

BRIEF SUMMARY OF THE DISCLOSURE

The invention more particularly includes a process for completing a subsea hydrocarbon well, the process comprising:

a) drilling through a hydrocarbon reservoir a producing section of a wellbore using a drilling assembly mounted to drill string;

b) using a drill string, running production liner and ball-activatable completion equipment into the producing section of the wellbore;

c) completing a first zone of the producing section by injecting stimulation fluid through the drill string and into a first portion of the production liner;

d) dropping an actuating device, e.g. a ball, through the drill string to open a second portion of the production liner and pass stimulation fluid into the second portion of production liner to complete a second zone of the well.

The invention also includes apparatus for stimulation of a hydrocarbon formation, the apparatus comprising: (a) a production liner including activatable completion equipment and a female seal element, e.g. polished bore receptacle at the proximal end of the liner; (b) a drill string having a male seal element, e.g. stinger, at its distal end, the male seal element being complementary to the female sealing element and capable of sealing with the female sealing element; and (c) a pair of valves in an assembly at a proximal end of the drill string to enable an actuating device, such as a ball, to be introduced into the drill string.

Various optional features of the method and apparatus are set out in the dependent claims appended to this specification.

Examples and various features and advantageous details thereof are explained more fully with reference to the exemplary, and therefore non-limiting, examples illustrated in the accompanying drawings and detailed in the following description. Descriptions of known starting materials and processes can be omitted so as not to unnecessarily obscure the disclosure in detail. It should be understood, however, that the detailed description and the specific examples, while indicating the preferred examples, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, product, article, or apparatus that comprises a list of elements is not necessarily limited only those elements but can include other elements not expressly listed or inherent to such process, process, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

The term substantially, as used herein, is defined to be essentially conforming to the particular dimension, shape or other word that substantially modifies, such that the component need not be exact. For example, substantially cylindrical means that the object resembles a cylinder, but can have one or more deviations from a true cylinder.

Additionally, any examples or illustrations given herein are not to be regarded in any way as restrictions on, limits to, or express definitions of, any term or terms with which they are utilized. Instead these examples or illustrations are to be regarded as being described with respect to one particular example and as illustrative only. Those of ordinary skill in the art will appreciate that any term or terms with which these examples or illustrations are utilized encompass other examples as well as implementations and adaptations thereof which can or cannot be given therewith or elsewhere in the specification and all such examples are intended to be included within the scope of that term or terms. Language designating such non-limiting examples and illustrations includes, but is not limited to: "for example," "for instance," "e.g.," "In some examples," and the like.

Although the terms first, second, etc. can be used herein to describe various elements, components, regions, layers and/or sections, these elements, components, regions, layers and/or sections should not be limited by these terms. These terms are only used to distinguish one element, component, region, layer or section from another. Thus, a first element, component, region, layer or section discussed below could be termed a second element, component, region, layer or section without departing from the teachings of the present inventive concept.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

In order fully to understand the invention, a currently used system will be explained with reference to FIGS. 1 and 2. In this description of a current system and the description of an embodiment of the invention which is given below, stimulation using acid is described, since the invention was devised with acid stimulation in mind. It should be understood, however, that the described prior art and the inventive solution could also relate to stimulation with different fluids, e.g. hydraulic stimulation using seawater and a proppant.

Figure 1:
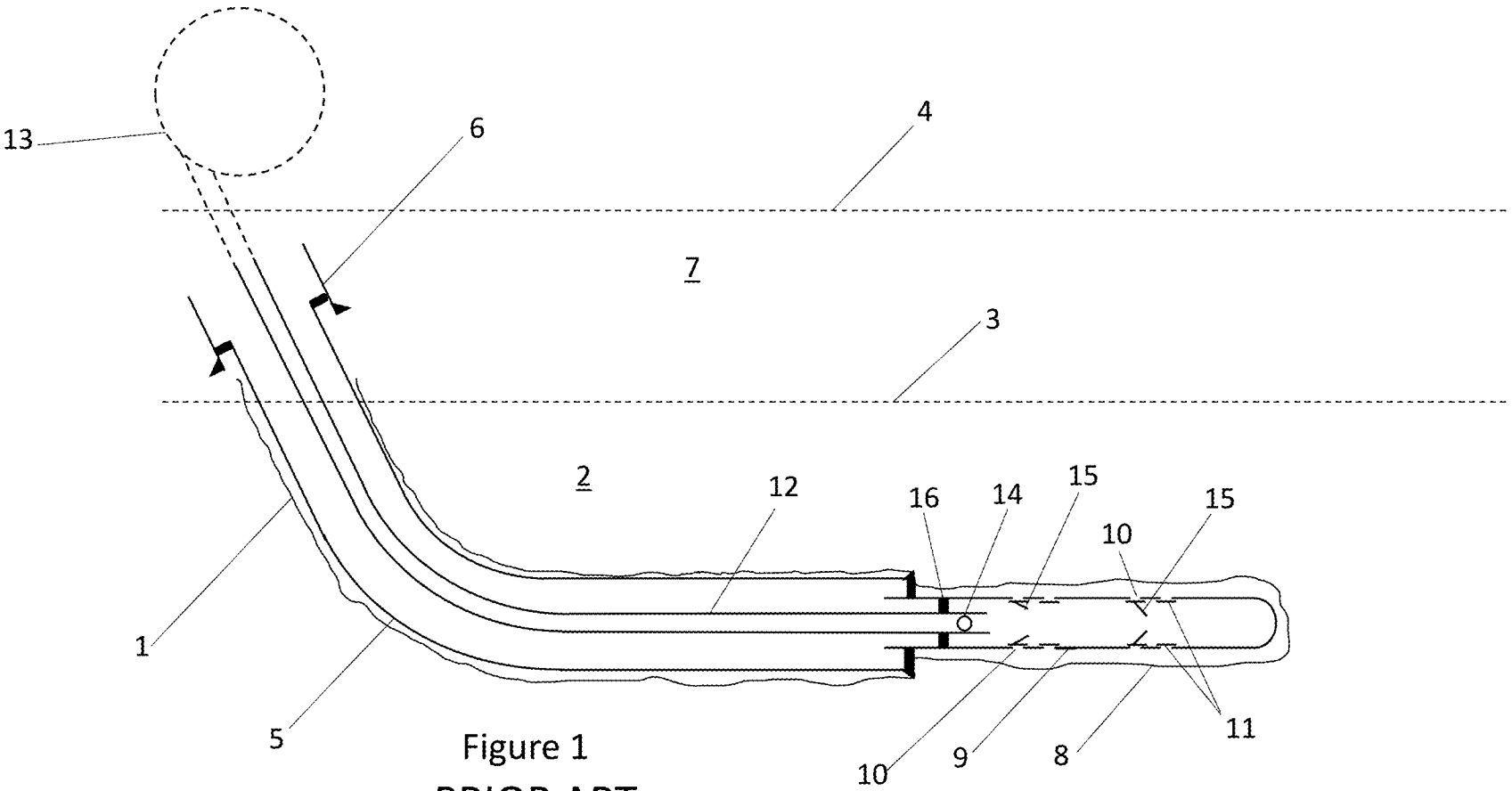
Figure 1 PRIOR ART
FIG. 1 shows prior art and is a schematic cross section through a well showing a first lateral and coil tubing completion.
Figure 2:
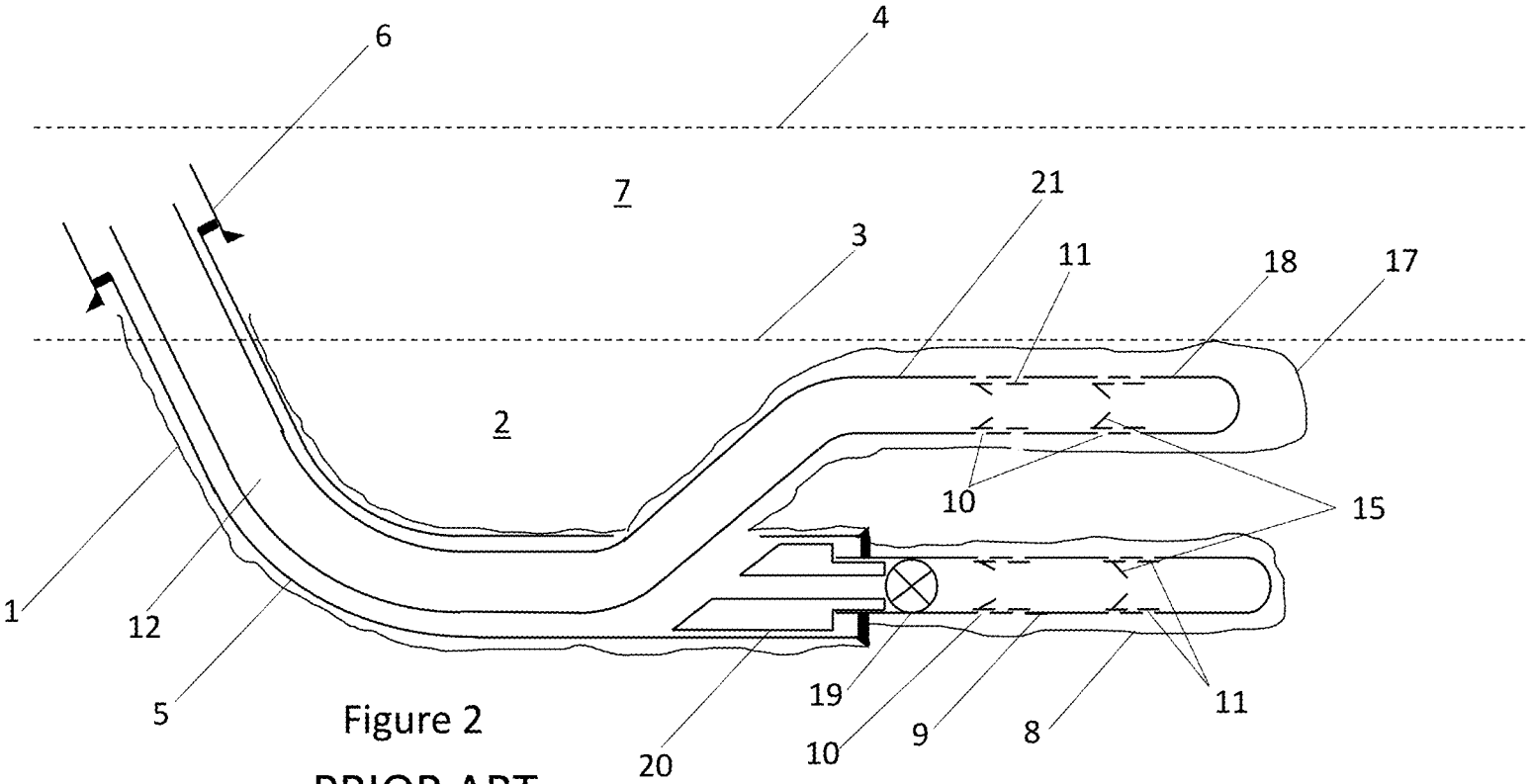
Figure 2 PRIOR ART
FIG. 2 shows prior art and is a schematic cross section through the well of FIG. 1 showing a second, branched lateral, for completion through the liner.

FIG. 1 shows a wellbore 1 extending into a section of hydrocarbon-bearing rock, or reservoir, 2. Although the wellbore 1 extends to the surface, this portion of the wellbore is omitted for clarity. A section of large diameter casing 6 is shown extending through the overburden rock 7 above the reservoir 2. Broken lines 3 and 4 show the boundaries between reservoir 2 and overburden 7, and between overburden 7 and surface, respectively. Although the well could be a subsea well, for clarity the sea surface is not represented. Smaller diameter casing 5 extends into the reservoir and, at the distal end of the wellbore is a smaller diameter producing section 8 into which extends production liner 9. The production liner 9 is fitted with completion equipment including sliding valve sleeves 11 controlling access to apertures 10 in the liner 9.

In order to complete the well, coil tubing 12 is run into the well from a reel 13. The reel would be part of a surface coil tubing unit (not shown for clarity, but conventional). The tubing 12 is run into the production liner 9 in order to deliver acid. A temporary packer 16 delivered with the coil tubing seals with the interior of the production liner 9 near the proximal end of the production liner.

Balls 14 of various sizes are run down the tubing and into the liner where the balls will, according to their size, engage with different parts of the completion equipment to open different apertures 10 and stimulate different parts of the formation. Completion equipment includes sliding valves shown generally at 11 and associated ball-activated mechanisms shown generally at 15. Alternatively, other types of actuator device may be dropped or pumped down the coil tubing, e.g. darts. Rather than having different diameters, the actuator devices may include key-like formations designed to engage with complementary formations on the mechanisms 15, so that a certain design of dart will only engage with a certain mechanism 15. Where the term "ball" is used in this specification, it is to be understood that any type of actuator device is meant.

Once the first lateral has been completed, coil tubing 12 is withdrawn and then the completed section is sealed off with a valve 19. This is shown in FIG. 2. A hollow whipstock 20 is run into the well and secured at the proximal end of the completed section, and then a second, branched, lateral well 17 is drilled and a second liner 18 run into the second lateral well 17. As with the first lateral, completion equipment comprising apertures 10, sliding valves 11 and ball actuated mechanisms 15 are included in the second liner 18. With the first lateral sealed off with ball valve 19 and hollow whipstock 20, the second lateral completed by passing acid and balls directly down the production liner 18 in the second lateral.

The method according to a first embodiment of the invention (shown in FIG. 3) differs in that:

- The acid and balls to control the stimulation operation in the first lateral are delivered through drill string instead of coil tubing;
- The distal end of the drill string includes a stinger which engages a polished bore receptacle at the proximal end of the production liner;
- This solution allows large balls or other actuator devices to be dropped because drill pipe has a larger diameter than coil tubing;
- Drill pipe can withstand higher pressures than coil tubing, so it is possible to deliver acid under high pressure without the need to pressurize the annulus around the drill pipe;

This solution saves rig time because the same rig which performs the drilling and casing functions using drill string can also perform the acid stimulation function.

Figure 3:
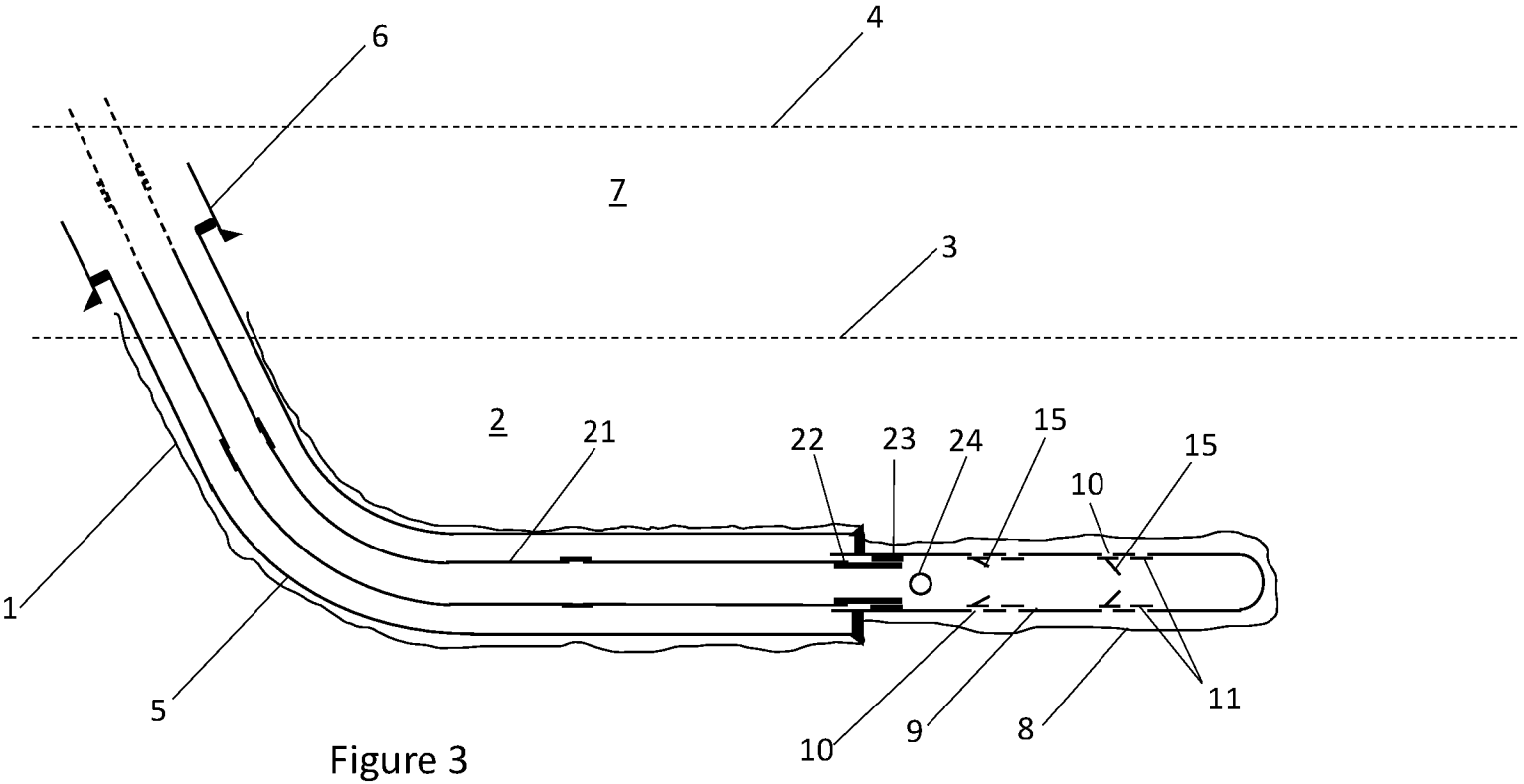
FIG. 3 is a view similar to FIG. 1 showing a technique according to the invention.

FIG. 3 shows a first lateral well being stimulated according to the invention. Similar reference numerals to those of FIGS. 1 and 2 designate similar parts. Instead of coil tubing, drill pipe 21 extends down the well from the surface. The drill pipe 21 is run from a drilling rig, shown in FIG. 4. At the distal end of the drill pipe 21 is a stinger 22 which is received within a polished bore receptacle 23 in the production liner 9 near the proximal end of the liner 9.

As with the arrangement of FIG. 1 acid balls (or other actuating devices) are pumped down the well to achieve stimulation of the well via the completion apparatus in the production liner. In the arrangement of FIG. 3, however, the acid and balls are pumped down drill string 21. The drill string has a larger diameter than coil tubing and allows larger balls or other actuating devices to be passed down it. Drill string is also able to withstand high pressures, so acid can be pumped at a high pressure without the need to pressurize the annulus around the drill string 21. The larger diameter and higher pressures allow a higher rate of acid flow than with coil tubing.

Figure 4:
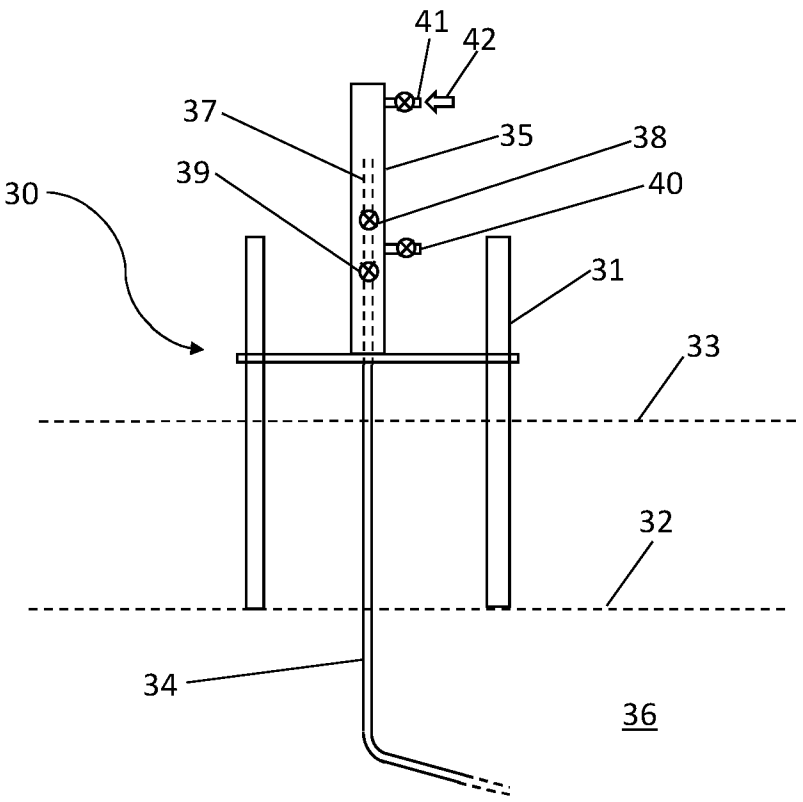
FIG. 4 is a schematic sectional view of a surface stack in a system according to the invention, allowing balls to be delivered through drill string.

FIG. 4 shows in highly schematic form a marine drilling rig 30 supported on legs 31 resting on the seafloor 32 and passing through the surface 33 of the sea. Drill pipe 34 extends from an assembly 35 on the rig 30 into rock 36 under the sea floor 32. The assembly, or stack, 35 includes a channel 37 which is a continuation of the bore of the drill pipe 34. The stack 35 comprises a number of valves and channels as is conventional, which are not shown. In addition, a pair of valves 38, 39 are provided in the channel 37, between which is a valved access point 40 allowing a ball or other actuating device to be inserted into the channel 37 and then dropped down the drill pipe.

As is conventional, drill pipe is fed down through the rig floor in sections or "joints" which are tightly joined together one by one as they a fed down into the cased well. The interior of the drill pipe is kept under pressure, and therefore valves are needed in order to place a ball, dart or other actuation device into the drill string. The stack 35 includes two ball valves ("FOSVs" or "full open safety valves") 35 to allow the bore to be isolated for this purpose. At the top of the stack is a further valved access point 41 for introducing pressurized acid 42 into the bore of the stack and into the drill pipe.

Stimulation fluid is normally delivered under pressure but this is not essential. Pressures at the formation can range from 0 to 8500 psi.

In closing, it should be noted that the discussion of any reference is not an admission that it is prior art to the present invention, especially any reference that may have a publication date after the priority date of this application. At the same time, each and every claim below is hereby incorporated into this detailed description or specification as a additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A process for completing a subsea hydrocarbon well, the process comprising:

a) using a marine drilling rig supported by legs resting on the seafloor, drilling through a hydrocarbon reservoir a producing section of a wellbore using a drilling assembly mounted to a drill string;

b) using said drilling rig and using the drill string, running production liner and ball-activatable or dart-activatable completion equipment into the producing section of the wellbore;

c) using said drilling rig, completing a first zone of the producing section by injecting stimulation fluid through the drill string and into a first portion of the production liner;

d) using said drilling rig, dropping a ball or dart through the drill string to open a second portion of the production liner and passing stimulation fluid into the second portion of production liner to complete a second zone of the well;

e) after stimulation of the producing section of the wellbore, and using said drilling rig, withdrawing the drill string from the wellbore and then, using said drilling rig, running the drilling assembly into the wellbore to a point proximal of the producing section, and drilling a second producing section, thereby creating a branched wellbore.

2. A process as claimed in claim 1, wherein:

(i) the production liner includes a female seal element;

(ii) following step (b), the drill string is withdrawn from the wellbore;

(iii) in step (c), the drill string is run into the wellbore, the drill string being fitted with a male seal element on the distal end of the drill string;

(iv) the male seal element engages with the female seal element and makes a seal before stimulation fluid is injected through the drill string into the production liner.

3. A process as claimed in claim 2, wherein the female seal element is a polished ring and the male seal element is a stinger.

4. A process as claimed in claim 1, wherein steps (b), (c) and (d) are completed on a single run of the drill string into the wellbore.

5. A process as claimed in claim 1, wherein a second production liner is run on drill string into the second producing section and then the drill string withdrawn and acid passed under pressure through the second production liner to complete the second producing section.

6. A process as claimed in claim 1, wherein all stimulation operations are performed before running in production tubing.

7. A process as claimed in claim 1, wherein the stimulation fluid is acid.

8. A process as claimed in claim 1, wherein the stimulation fluid is 20-40% hydrochloric acid.

9. A process as claimed in claim 1, wherein the fluid is delivered through the drill string at a pressure of between 4,000 psi and 7,500 psi without pressurizing an annular space around the drill string to support the drill string.

* * * * *